United States Patent [19]

Vermeulen et al.

[11] Patent Number: 4,686,170

[45] Date of Patent: Aug. 11, 1987

[54] PHOTOGRAPHIC SILVER COMPLEX DIFFUSION TRANSFER REVERSAL PROCESS UNDER YELLOW SAFELIGHT

[75] Inventors: Leon L. Vermeulen, Herenthout; Theofiel H. Ghys, Kontich; Willy P. De Smedt, Mechlin; Ludovicus H. Vervloet, Kessel; Paul R. Callant, Edegem, all of Belgium

[73] Assignee: Agfa-Gevaert N.V., Mortsel, Belgium

[21] Appl. No.: 848,267

[22] Filed: Apr. 4, 1986

[30] Foreign Application Priority Data

Apr. 9, 1985 [XH] 04091985 ..... 85200546.1

[51] Int. Cl.[4] ..... G03C 5/54; G03C 1/16

[52] U.S. Cl. ..... 430/244; 430/204; 430/230; 430/583

[58] Field of Search ..... 430/230, 244, 204, 583

[56] References Cited

U.S. PATENT DOCUMENTS

| | | | |
|---|---|---|---|
| 4,242,436 | 12/1980 | Mertens et al. | 430/230 |
| 4,250,244 | 2/1981 | Borror et al. | 430/583 |
| 4,563,410 | 1/1986 | De Jaeger et al. | 430/204 |

*Primary Examiner*—Richard L. Schilling
*Attorney, Agent, or Firm*—William J. Daniel

[57] ABSTRACT

Photographic silver complex diffusion transfer reversal process wherein the photographic material is spectrally sensitized with a dye corresponding to the general formula of the description, wherein said dye provides to the silver halide emulsion layer a spectral sensitivity mainly in the range of 400 to 500 nm and does not extends its spectral sensitivity substantially beyond 500 nm, and wherein the handling (exposure, development and diffusion transfer) of the photographic material during said steps is effected in yellow safelight corresponding to the light transmitted by a specified cut-off filter without causing fog.

10 Claims, 2 Drawing Figures

Figure 1:
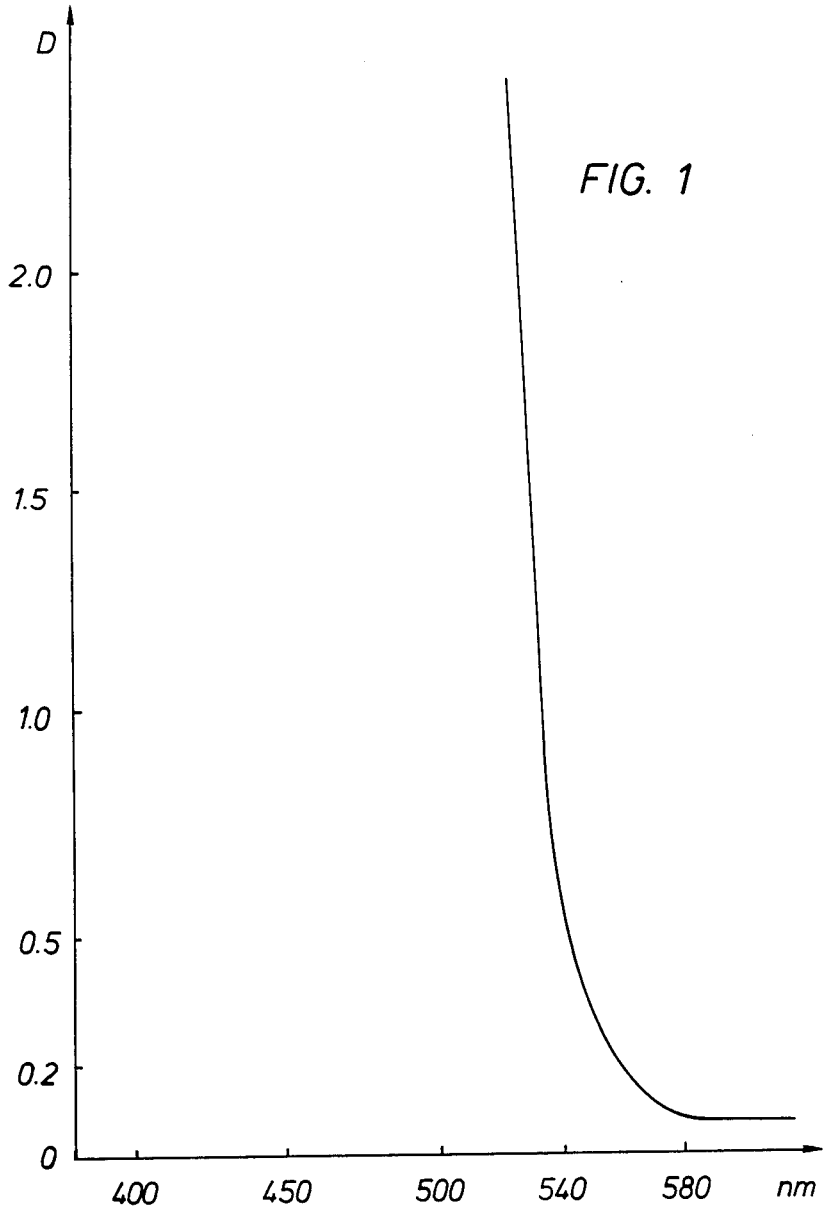

PHOTOGRAPHIC SILVER COMPLEX DIFFUSION TRANSFER REVERSAL PROCESS UNDER YELLOW SAFELIGHT

DESCRIPTION

The present invention relates to a photographic silver complex diffusion transfer reversal process.

The principles of the photographic silver complex diffusion transfer reversal process, herein called DTR-process have been described e.g. in U.S. Pat. No. 2,352,014 of André Rott, issued June 20, 1944.

In the DTR-process, silver complexes are image-wise transferred by diffusion from an image-wise exposed and developed silver halide emulsion layer to an image-receiving layer, where they are converted into a silver image. For this purpose, an image-wise exposed silver halide emulsion layer is developed by means of a developing substance in the presence of a so-called silver halide solvent. In the exposed parts of the silver halide emulsion layer the silver halide is developed to silver so that it cannot dissolve anymore and consequently cannot diffuse. In the non-exposed parts of the silver halide emulsion layer the silver halide is converted into soluble silver complexes by means of a silver halide complexing agent (a so-called silver halide solvent) and transferred by diffusion to an adjacent image receiving layer or to an image-receiving layer of a separate image-receptor material brought into contact with the emulsion layer to form, usually in the presence of development nuclei, a silver, or silver-containing image in the receiving layer. More details on the DTR-process can be found in the book "Photographic Silver Halide Diffusion Processes" by A. Rott and E. Weyde, Focal Press, London, New York (1972).

It is well known that the spectral sensitivity of the silver halide is an important factor in the total sensitivity of the photographic material and defines the possibility to handle the material under a particular darkroom safelight.

It is further known (ref. the above mentioned book, p. 45) to make the photographic silver halide emulsion material, called negative, capable of being handled under daylight conditions by adding yellow dyes, viz. so-called screening dyes, to the silver halide emulsion layer. Owing to their light-absorption-spectrum these yellow screening dyes block the light whereto the silver halide is inherently sensitive. In particular circumstances, however, the reduction of the blue-sensitivity of the photograhic material and a corresponding reduction of total sensitivity is not desirable since the loss of sensitivity is prohibitive for the use of exposure apparatus having a limited light output as is the case in contact exposure apparatus operating with fluorescent tubes or for the use in scanning exosures. Moreover, some photographic materials intended for high quality reproduction work, e.g. in the production of screened photographs contain anti-halation layer(s) to improve the resolution and the exposure latitude at the expense of photographic sensitivity so that total sensitivity becomes critical for a lot of exposure applications. Anti-halation layers suited for extending exposure latitude and improving image resolution are described e.g. in U.S. Pat. No. 3,615,443.

In view of the reduction in sensitivity by the measures described, the advantage of favourable handling conditions i.e. under daylight conditions is associated with too strong a reduction in photographic sensitivity for recording purposes in common exposure apparatus. As a convenient alternative to handling under daylight conditions it would be desirable to be capable of handling in yellow safelight, so that the visual inspection and positioning of the photographic material with respect to the original and/or contact screens is made particularly easy, while maintaining sufficient total sensitivity for the above common exposure conditions.

It is an object of the present invention to provide a DTR-process suited for the production of photographic images, especially halftone images of high quality, under handling conditions of yellow safelight without causing fog to a noteworthy extent.

It is further an object of the present invention to provide a DTR-process wherein in a photographic silver halide emulsion layer specific dyes for sensitizing silver halide to a spectral wavelength range not substantially beyond 500 nm are used and that do not diffuse materially from the photosensitive layer into the image receiving layer during the diffusion transfer.

Other objects and advantages of the present invention will become clear from the further description.

The photographic silver complex diffusion transfer reversal process according to the present invention comprises the steps of: (1) exposing a photographic material comprising a support and a silver halide emulsion layer containing silver halide grains, including at least 70 mole % of silver chloride dispersed in a hydrophilic colloid binder, which grains are spectrally sensitized, (2) developing the image-wise exposed silver halide emulsion layer in the presence of a developing agent and a silver halide solvent being a silver halide complexing agent, and (3) transferring by diffusion dissolved complexed silver halide from said emulsion layer into an image-receiving layer that forms an integral part of the photographic material while being present on the same support in water-permeable relationship with the silver halide emulsion layer or that forms part of a separate image receiving material, wherein said image-receiving layer contains development nuclei acting as physical development catalyst for the dissolved complexed silver halide, and is characterised in that the silver halide grains are spectrally sensitized with at least one dye corresponding to the following general formula:

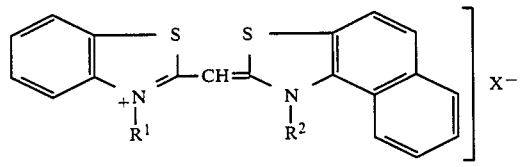

wherein:

each of $R^1$ and $R^2$ (the same or different) represents an alkyl group, e.g. methyl, ethyl, or substituted alkyl group, e.g. an alkyl group substituted with a $—SO_3^-$ group or —COOH group, and $X^-$ represents an anion or is missing when $R^1$ or $R^2$ already contains an anionic structural part, e.g. when $R^1$ or $R^2$ is a $—(CH_2)_3—SO_3^-$ group, and wherein, said dye or a mixture of said dyes provides to the silver halide emulsion layer a spectral sensitivity mainly in the range of 400 to 500 nm and does not extend its spectral sensitivity substantially beyond 500 nm so that the sensitivity of said layer at 530 nm is at least $2^7$ lower than that at 500 nm, and the handling of the photographic material during said steps (1) to (3) is effected under yellow safelight conditions corresponding to the light transmitted by a cut-off filter having at 500 nm a density of at least 2.5, at 530 nm a density not larger than 2.0, at 540 nm a density not larger than 1.0, at 550 nm a density not larger than 0.4, at 560 nm a density not larger than 0.2 and beyond 580 nm a density not larger than 0.1.

Figure 2:
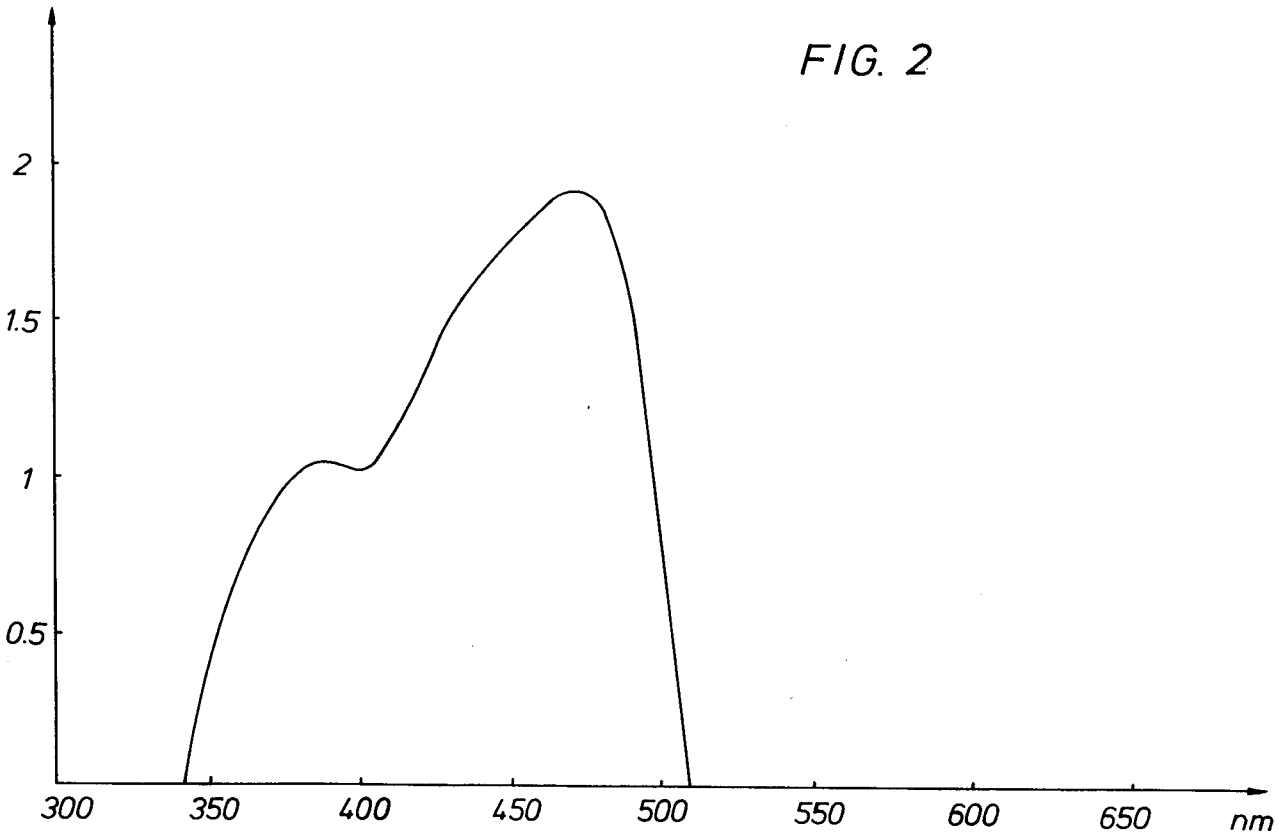

In the accompanying drawings in FIG. 1 the density versus wavelength curve of a cut-off filter suitable for use according to the present invention is given and in FIG. 2 the spectral sensitization curve (density versus wavelength) of a favoured spectral sensitization dye for use according to the present invention is illustrated.

The preparation of monomethine spectral sensitizing dyes according to the above general formula is described e.g. in J. Chem. Soc. 1949, 1503–1507 and may proceed likewise according to the reaction scheme disclosed in GB-P No. 660,408.

Spectral sensitizing dyes according to the above general formula have been described already in U.S. Pat. No. 4,232,118 for use in admixture with other monomethine spectral sensitizing dyes in the production of a photographic material showing less formation of fog during storage.

Further it is known from published French patent application No. 2 379 577 to use spectral sensitizing dyes according to the above general formula for sensitization to blue light of photosensitive silver halide in diffusion transfer environment for the production of dye images by means of a photographic material containing a plurality of differently spectrally sensitized silver halide emulsion layers, wherein by said spectral sensitizing dyes the desired equilibrium in sensitivity for the emulsion layer sensitive to green light and the emulsion layer sensitive to blue light is obtained.

Preferred representatives according to the above general formula are listed in the following table 1 by their $R^1$, $R^2$ and $X^-$ groups.

TABLE 1

| dye no. | $R_1$ | $R_2$ | $X^-$ |
|---|---|---|---|
| 1 | $C_2H_5$ | $C_2H_5$ | p-sulpho-tolyl |
| 2 | $CH_3$ | $C_2H_5$ | idem |
| 3 | $CH_3$ | $CH_3$ | idem |
| 4 | $C_2H_5$ | $CH_3$ | idem |
| 5 | $(CH_2)_3—SO_3^-$ | $C_2H_5$ | none |
| 6 | $C_2H_5$ | $(CH_3)_3—SO_3^-$ | none |
| 7 | $C_2H_5$ | $CH_3$ | ethyl sulphate |
| 8 | $(CH_2)_3—SO_3^-$ | $CH_3$ | none |
| 9 | $CH_3$ | $CH_3$ | methyl sulphate |
| 10 | $(CH_2)_2—COOH$ | $CH_3$ | $I^-$ |

The silver halide of the emulsions used in the present invention consists of at least 70 mole % of silver chloride since silver chloride inherently has low spectral sensitivity beyond 500 nm and is rapidly complexed by silver halide solvent. Preferably the silver halide consists for 85 to 100 mole % of silver chloride, the remainder, if any, being preferably bromide. The average grain-size is e.g. in the range of 200–300 nm.

The spectral sensitizing dye is present in the silver halide emulsion layer preferably in an amount to reach maximum total sensitivity, and may be e.g. in the range of 100 to 850 mg per mole of silver halide.

A suitable coverage of silver halide expressed in g of silver nitrate per sq.m is in the range of 0.7 g/sq.m to 5 g/sq.m.

The binder for the silver halide emulsion layer is preferably gelatin. However, the gelatin may be wholly or partly replaced by other natural and/or synthetic hydrophilic colloids e.g. albumin, casein or zein, polyvinyl alcohol, alginic acids, cellulose derivatives such as carboxymethyl cellulose, etc. The weight ratio of hydrophilic colloid to silver halide expressed as silver nitrate is e.g. between 0.4:1 to 6:1. A relatively high ratio by weight of hydrophilic colloid to silver halide is in favour of the production of continuous tone images by the DTR-process as described e.g. in U.S. Pat. Nos. 3,985,561 and 4,242,436.

In addition to the binder and the silver halide, the photographic material may contain in the light-sensitive emulsion layer and/or in one or more layers in water-permeable relationship with the silver halide emulsion layer any of the kinds of compounds customarily used in such layers for carrying out the silver complex diffusion transfer process. For example such layers may incorporate one or more developing agents, coating aids, stabilizing agents or antifogging agents e.g. as described in the British Patent Specification No. 1,007,020 filed Mar. 6, 1963 by Agfa A.G., plasticizers, development modifying agents e.g. polyoxyalkylene compounds and onium compounds, spectral sensitizing agents, etc.

In graphic art material for line and/or halftone image formation according to the DTR-process an antihalation layer is preferably arranged between the emulsion layer and the support but may be present likewise at the rearside of the support.

In an anti-halation layer for use in the process of the present invention any diffusion resistant antihalation dye or pigment may be used that absorbs the exposure light to which the silver halide emulsion layer is sensitive. Particularly suited light-absorbing substances for use in an antihalation layer applied in the present invention are carbon black and yellow pigments, e.g. C.I. Pigment Yellow 1 (C.I. 11,680), C.I. Pigment Yellow 16 (C.I. 20,040), C.I. Pigment Orange 5 (C.I. 12,075), C.I. Pigment Orange 34 (C.I. 21,115) or red pigments, e.g. C.I. Pigment Red 3 (C.I. 12,120) and/or C.I. Pigment Red (C.I. 12,370). Said pigments may be used in admixture and wholly or partially may replace carbon black.

An antihalation layer on the basis of carbon black or diffusion-resistant organic pigments does not need to be discoloured during processing where the DTR-image is formed on a separate support or shielded from the antihalation layer by a sufficiently opaque white intermediate layer.

The use of a black antihalation layer in combination with a white reflection layer in a photographic silver halide emulsion material suited for use in DTR-processing is described e.g. in U.S. Pat. No. 4,144,064.

The use of an antihalation layer coated between the silver halide emulsion layer and the support provides a better sharpness and improved fine screen dot rendering than when coated on the rear-side of the support. On using carbon black or diffusion resistant organic pigments as antihalation substances there is no risk for a disadvantageous effect of the antihalation layer on the sensitometric characteristics of the emulsion.

The carbon black is e.g. lampblack having an average grain size in the range of 10 to 50 nm, and is used preferably in a ratio by weight of 3 to 50% with respect to a hydrophilic colloid binder, e.g. gelatin.

The use of carbon black in antihalation layers is known e.g. from GB-P No. 1,541,303.

The optical density of the antihalation layer is preferably not smaller than 0.3 with respect to the light used in the image-wise exposure. An optical density in the range of 1.5 to 2.0 yields very favourable improvement of image sharpness. Said density may be obtained by using coloured pigments solely or by using a mixture of coloured pigments with white pigments, e.g. carbon black in admixture with titanium dioxide.

The support of the photographic material may be any of the supports customarily employed in the art. These include supports of paper, glass or film, e.g. cellulose acetate film, polyvinyl acetal film, polystyrene film, polyvinylchloride film or polyethylene terephthalate film as well as metal supports and metal supports laminated at both sides with paper. Paper supports coated at one or both sides with an alpha-olefin polymer, e.g. polyethylene, are used preferably. In order to compensate for the curling tendency of the light-sensitive material it is possible to coat one side of the support with a polyethylene layer whose specific density and/or thickness differs from that at the other side of the support. The compensating action can also be improved by a hydrophilic colloid anti-curling layer optionally incorporating matting agents.

The emulsion-coated side of the light-sensitive material may be provided with a top layer that is usually made from gelatin or other water-permeable colloid. The top layer is of such nature that the diffusion is not inhibited or restrained and that it acts e.g. as a protective layer, i.e. an antistress layer. Appropriate water-permeable binding agents other than gelatin for the layer coated on top of the light-sensitive silver halide emulsion layer are e.g. methyl cellulose, the sodium salt of carboxymethyl cellulose, hydroxyethyl cellulose, hydroxyethyl starch, hydroxypropyl starch, sodium alginate, gum tragacanth, starch, polyvinyl alcohol, polyacrylic acid, polyacrylamide, polyvinyl pyrrolidone, polyoxyethylene, copoly(methylvinylether/-maleic acid), etc. The thickness of this layer may vary according to the nature of the colloid used. Such layer, if present, may be transferred at least partially to the image-receiving layer when the diffusion process comes to an end.

For carrying out the silver complex diffusion transfer process it is common practice to incorporate at least partly the developing agent(s) into the light-sensitive silver halide emulsion layer and/or the image-receiving layer, or other water-permeable layer, e.g. in the antihalation layer, adjacent thereto.

Suitable developing agents for the exposed silver halide are, e.g., hydroquinone and 1-phenyl-3-pyrazolidinone type-developing agents and likewise p-monomethylaminophenol. The developer or an activator liquid contains in the process for forming a silver image through the silver complex diffusion transfer process a silver halide solvent, e.g., a complexing compound such as an alkali metal or ammonium thiosulphate or thiocyanate, or ammonia. Alternatively or in addition such complexing compounds may be present in the image-receiving layer. An activator liquid is an aqueous liquid initially free from developing agents when the latter are originally present in the photographic material and/or in the image-receiving material and are activated on wetting with the activator liquid.

The preparation of the silver halide emulsion of the material according to the present invention proceeds in a known way by precipitation reaction of halides, e.g. ammonium halide, potassium, sodium, lithium or strontium halide with silver salts, e.g. silver nitrate, in a hydrophilic protective binder which is preferably gelatin. When developing agents are added then they are preferably added to the silver halide emulsion composition after the chemical ripening stage following the washing of the emulsion.

As already mentioned according to one embodiment the image-receiving layer for use according to the present invention may form an integral part of the photographic material, in other words forms a mono-sheet system.. In an embodiment of said mono-sheet system the image-receiving layer is separated from the silver halide emulsion layer by an opaque but waterpermeable layer. The opaque layer precludes the detection by the eye of a silver image formed in the silver halide emulsion layer. Examples of opaque pigment layers suited for the above purpose are described in the German Auslegeschrift 1,961,030, in the German Offenlegungsschrift No. 1,772,603 in the BE-P No. 526,587, in the GB-P No. 878,064 and in the U.S. Pat. No. 3,928,037.

In an other embodiment of the mono-sheet system the photosensitive layer is removable from the image-receiving layer, e.g. by washing after processing as described e.g. in GB-P Nos. 687,751, 1,000,116, 1,026,772 and in U.S. Pat. Nos. 2,964,405, 3,020,155 and 3,684,508.

The image-receiving layer when making part of a material separate from the photographic material may comprise an opaque or transparent support which includes supports of the kind described hereinbefore for the light-sensitive layer.

The image-receiving layer may contain one or more agents for promoting the reduction to metallic silver of the complexed silver salt, these agents being called development nuclei. Such development nuclei have been described in the above-cited book of A. Rott and E. Weyde, p.54–57. Preferably nickel sulphide nuclei are used. Development nuclei can also be incorporated into the processing liquid as is described in the United Kingdom Patent No. 1,001,558, filed Apr. 13, 1962 by Gevaert Photo-Producten N.V. to form nuclei in situ in the image-receiving layer.

In one or more layers of the image-receiving material, substances may be incorporated, which play a prominent role in the formation of diffusion transfer images. Such substances include black-toning agents, e.g. those described in the United Kingdom Patent No. 561,875, filed Dec. 3, 1942 by Ilford Ltd. and in the Belgian Patent No. 502,525 filed Apr. 12, 1951 by Agfa A.G. A preferred black-toning agent is 1-phenyl-5-mercaptotetrazole.

The image-receiving layer may consist of or comprise any of the binding agents mentioned hereinbefore for the silver halide. Gelatin is the preferred binding agent for the image-receiving layer.

The image-receiving layer may also comprise a silver halide solvent, e.g. sodium thiosulphate in an amount of about 0.1 to about 4 g per sq.m.

The image-receiving layer may be hardened so as to improve its mechanical strength. Hardening agents for colloid layers include e.g. formaldehyde, glyoxal, mucochloric acid, and chrome alum. Hardening may also be effected by incorporating a latent hardener in the colloid layer, whereby a hardener is released at the stage of applying the alkaline processing liquid.

Further information on the composition of the image-receiving layer can be found in said book of André Rott and Edith Weyde p.50–65.

The support and/or surface of the image-receiving layer may be provided with printing e.g. any type of recognition data applied by any type of conventional printing process such as offset printing, intaglio printing and water mark.

When the developing substance(s) have been applied already in the photographic material during its manufacture, the processing liquid used in the DTR-process according to the present invention contains alkaline substances, e.g. tribasic sodium phosphate, and optionally preservatives, e.g. sodium sulphite, thickening agents, e.g. hydroxyethyl cellulose and carboxymethyl cellulose, fog-inhibiting agents, e.g. potassium bromide, silver halide-complexing agents as "silver halide solvents", e.g. sodium thiosulphate and black-toning agents especially heterocyclic mercapto compounds, e.g. 1-phenyl-5-mercaptotetrazole. The pH of the procesing liquid is preferably in the range of 10 to 14.

The amount of sodium thiosulphate in said liquid is e.g. in the range of 10 g/l to 30 g/l.

The present invention includes a DTR-process which is especially useful for producing a halftone image e.g. screened image in an image-receiving material.

For particulars about the developing apparatus. which may be applied in a process according to the present invention reference is made e.g. to the already mentioned book of A. Rott and E. Weyde.

The present invention is illustrated by the following example. All percentages and ratios are by weight unless otherwise stated.

EXAMPLE

Preparation of the photographic material.

Antihalation layer.

An antihalation layer on the basis of gelatin and carbon black was applied to a polyethylene coated paper support which before coating was corona-treated to improve the adherence to gelatin. The coating of that layer proceeded in such a way that the reflection optical density for visual filter light measured with a MACBETH (registered trade mark) RD-100R densitometer after drying was 1.5. "Visual filter"-light is light having a spectral range distribution approximately characteristic for the human eye sensitivity. The weight ratio of gelatin to carbon black was 10/1.

Preparation of the silver halide emulsion and its coating.

To a washed gelatino silver chlorobromide emulsion (98.2 mole % of chloride) a spectral sensitizing agent with structural formula 1 of Table 1 (0.4 g per mole silver halide), common stabilizing agents, and hydroquinone and 1-phenyl-4-methyl-3-pyrazolidinone as developing agents were added. The coating of the emulsion onto the antihalation layer proceeded in such a way that the silver halide was present at a coverage equivalent with 2.5 g silver nitrate per sq.m. The weight ratio of gelatin with respect to the silver halide expressed as silver nitrate was 1.2. Hydroquinone and 1-phenyl-4-methyl-3-pyrazolidinone were present at a coverage of 0.90 g and 0.25 g per sq.m respectively.

Image-receiving material

The image-receiving material used in conjunction with the above photographic material in diffusion transfer reversal (DTR-) processing was prepared by coating a subbed polyethylene terephthalate film support with an aqueous colloidal dispersion containing 11% of gelatin and 0.2% of silver sulphide development nuclei. The obtained dispersion was coated at a gelatin coverage of 2.5 g per sq.m and dried.

Exposure and processing

In a vertical darkroom camera without reversing mirror the photographic material was positioned and exposed with respect to a continuous tone black-and-white original combined for direct screening with a contact screen. The positioning and exposure proceeded under yellow safelight conditions obtained with the filter having the density-versus-wavelength characteristics illustrated in the accompanying FIG. 1. The exposure proceeded with the emulsion layer side of the photographic material towards the camera lens. Hereby in DTR-processing a wrong-reading negative was obtained on the photosensitive material and a right reading positive print on the image-receiving material.

After the exposure the photographic material was introduced under the same safelight conditions with the above-described image-receiving material into a diffusion transfer processing apparatus containing a liquid of the following composition:

| | |
|---|---|
| water | 800 ml |
| tribasic sodium phosphate.12 $H_2O$ | 75 g |
| anhydrous sodium sulphite | 40 g |
| potassium bromide | 0.5 g |
| anhydrous sodium thiosulphate | 20 g |
| 1-phenyl-5-mercaptotetrazole | 70 mg |
| water to make | 1000 ml |

When the sandwich of the photographic material and image-receiving material left the squeezing rollers of the diffusion transfer apparatus, the materials were still kept in contact for 60 s and then separated from each other.

The whole procedure of exposure and DTR-processing lasted 120 seconds. In that period no visible fog was produced in the photographic material under the described safelight circumstances providing an illumination of 75 lux at the surface of the photographic material.

The positive print obtained on the image-receiving material was composed of screen dots having a very high accutance showing in the background no dye stain or other visible fog.

We claim:

1. A photographic silver complex diffusion transfer reversal process which comprises the steps of:

(1) exposing a photographic material comprising a support and a silver halide emulsion layer containing silver halide grains dispersed in a hydrophilic colloid binder, the silver halide grains including at least 70 mole % of silver chloride and being spectrally sensitized, (2) developing the image-wise exposed silver halide emulsion layer in the presence of a developing agent and a silver halide solvent being a silver halide complexing agent, (3) transferring by diffusion dissolved complexed silver halide from said emulsion layer into an image-receiving layer that forms an integral part of the photographic material while being present on a same support in water-permeable relationship with the silver halide emulsion layer or that forms part of a separate image receiving material, the image-receiving layer containing development nuclei acting as physical development catalyst for the dissolved complexed silver halide, and is characterised in that the silver halide grains are spectrally sensitized with at least one dye corresponding to the following general formula:

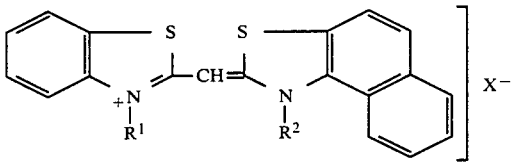

wherein:

each of $R^1$ and $R^2$ (the same or different) represents an alkyl group, and $X^-$ represents an anion or is missing when $R^1$ or $R^2$ already contains an anionic structural part, and wherein, said dye or a mixture of said dyes provides to the silver halide emulsion layer a spectral sensitivity mainly in the range of 400 to 500 nm and does not extend its spectral sensitivity substantially beyond 500 nm so that the sensitivity of said layer at 530 nm is at least $2^7$ lower than that at 500 nm, and wherein the handling of the photographic material during said steps (1) to (3) is effected under yellow safelight conditions corresponding to the light transmitted by a cut-off filter having at 500 nm a density of at least 2.5, at 530 nm a density not larger than 2.0, at 540 nm a density not larger than 1.0, at 550 nm a density not larger than 0.4, at 560 nm a density not larger than 0.2 and beyond 580 nm a density not larger than 0.1.

2. Process according to claim 1, wherein each of $R^1$ and $R^2$ (the same or different) represents a methyl or ethyl group.

3. Process according to claim 1, wherein the silver halide contains siver chloride in the range of 85 to 100 mole %.

4. Process according to claim 1, wherein the spectral sensitizing dye is present in the silver halide emulsion layer in an amount in the range of 100 to 850 mg per mole of silver halide.

5. Process according to claim 1, wherein the silver halide is present in the silver halide emulsion layer expressed in g of silver nitrate per sq.m in the range of 0.7 g/sq.m to 5 g/sq.m.

6. Process according to claim 1, wherein the photographic material comprises an antihalation layer.

7. Process according to claim 6, wherein the antihalation layer is present between the silver halide emulsion layer and the support of the photographic material.

8. Process according to claim 6, wherein the antihalation layer has an optical density not smaller than 0.3.

9. Process according to claim 8, wherein the optical density of the antihalation layer is in the range of 1.5 to 2.0.

10. Process according to claim 1, wherein the photographic material contains developing agent(s) and the development is carried out with the aid of an alkaline aqueous liquid being initially free from developing agent(s).

* * * * *

UNITED STATES PATENT AND TRADEMARK OFFICE

CERTIFICATE OF CORRECTION

PATENT NO. : 4,686,170

DATED : August 11, 1987

INVENTOR(S) : Leon L. Vermeulen et al

It is certified that error appears in the above-identified patent and that said Letters Patent is hereby corrected as shown below:

In the Heading:

In item [30] Foreign Application Priority Data,

"Apr. 9, 1985 [XH] 04091985 ..... 85200546.1" should read

-- Apr. 9, 1985 [EP] European Pat. Off. ..... 85200546.1 --.

Signed and Sealed this

First Day of December, 1987

*Attest:*

DONALD J. QUIGG

*Attesting Officer*

*Commissioner of Patents and Trademarks*